US010655858B2

(12) United States Patent
Bailey et al.

(10) Patent No.: US 10,655,858 B2
(45) Date of Patent: May 19, 2020

(54) COOLING OF LIQUID FUEL CARTRIDGE IN GAS TURBINE COMBUSTOR HEAD END

(71) Applicant: General Electric Company, Schenectady, NY (US)

(72) Inventors: Donald Mark Bailey, Simpsonville, SC (US); Lucas John Stoia, Taylors, SC (US); Timothy James Purcell, Centerville, OH (US)

(73) Assignee: General Electric Company, Schenectady, NY (US)

( * ) Notice: Subject to any disclaimer, the term of this patent is extended or adjusted under 35 U.S.C. 154(b) by 413 days.

(21) Appl. No.: 15/625,061

(22) Filed: Jun. 16, 2017

(65) Prior Publication Data

US 2018/0363906 A1 Dec. 20, 2018

(51) Int. Cl.

| | |
|---|---|
| ***F23R 3/28*** | (2006.01) |
| ***F23R 3/34*** | (2006.01) |
| ***F23R 3/36*** | (2006.01) |
| ***F23R 3/04*** | (2006.01) |

(52) U.S. Cl.

CPC ..... *F23R 3/283* (2013.01); *F23R 3/04* (2013.01); *F23R 3/286* (2013.01); *F23R 3/34* (2013.01); *F23R 3/343* (2013.01); *F23R 3/36* (2013.01)

(58) Field of Classification Search

CPC ..... F23R 3/283; F23R 3/343; F23R 3/286; F23R 3/34; F23R 3/36; F23R 3/346; F23R 3/04

See application file for complete search history.

(56) References Cited

U.S. PATENT DOCUMENTS

| | | | |
|---|---|---|---|
| 3,668,869 | A | 6/1972 | DeCorso et al. |
| 4,833,878 | A | 5/1989 | Sood et al. |
| 5,408,825 | A | 4/1995 | Foss et al. |
| 5,437,159 | A | 8/1995 | Ansart et al. |
| 5,657,632 | A | 8/1997 | Foss |
| 5,924,275 | A | 7/1999 | Cohen et al. |
| 6,397,602 | B2 | 6/2002 | Vandervort et al. |
| 8,136,359 | B2 | 3/2012 | Stuttaford et al. |
| 8,522,554 | B2 | 9/2013 | Intile et al. |
| 8,671,691 | B2 | 3/2014 | Boardman et al. |
| 9,188,341 | B2 | 11/2015 | McMasters et al. |
| 9,217,570 | B2 | 12/2015 | Parsania et al. |
| 9,261,279 | B2 | 2/2016 | Westmoreland et al. |
| 9,366,440 | B2 | 6/2016 | Berry |

(Continued)

OTHER PUBLICATIONS

"How to Bend Tubes and Sections", HiTech Alloys, Copyright 2002-2008, printed Jan. 25, 2017 from http://www.hitechalloys.com/hitechalloys_005.htm.

*Primary Examiner* — Steven M Sutherland
(74) *Attorney, Agent, or Firm* — Charlotte C. Wilson; James W. Pemrick

(57) ABSTRACT

The present disclosure provides assemblies for cooling a liquid fuel cartridge unit within a combustor head end. In one embodiment, the cooling is accomplished passively as air from the head end air plenum is directed into a cooling channel radially outward of a liquid fuel delivery conduit. In another embodiment, the cooling of the liquid fuel cartridge unit is accomplished actively as air is directed through a first air flow conduit radially inward of the liquid fuel delivery conduit and then redirected through a second air flow conduit radially outward of the liquid fuel delivery conduit.

8 Claims, 9 Drawing Sheets

(56) References Cited

U.S. PATENT DOCUMENTS

| | | | | |
|---|---|---|---|---|
| 9,383,098 | B2 | 7/2016 | Means et al. | |
| 9,476,592 | B2 | 10/2016 | Berry | |
| 2004/0045295 | A1* | 3/2004 | Wiebe | F23D 14/78 60/737 |
| 2009/0014561 | A1 | 1/2009 | McMasters et al. | |
| 2010/0223929 | A1* | 9/2010 | Bailey | F23D 11/107 60/737 |
| 2013/0263571 | A1* | 10/2013 | Stoia | F23C 6/047 60/39.463 |
| 2015/0135716 | A1 | 5/2015 | Ginessin et al. | |
| 2016/0033138 | A1 | 2/2016 | Graham et al. | |

* cited by examiner

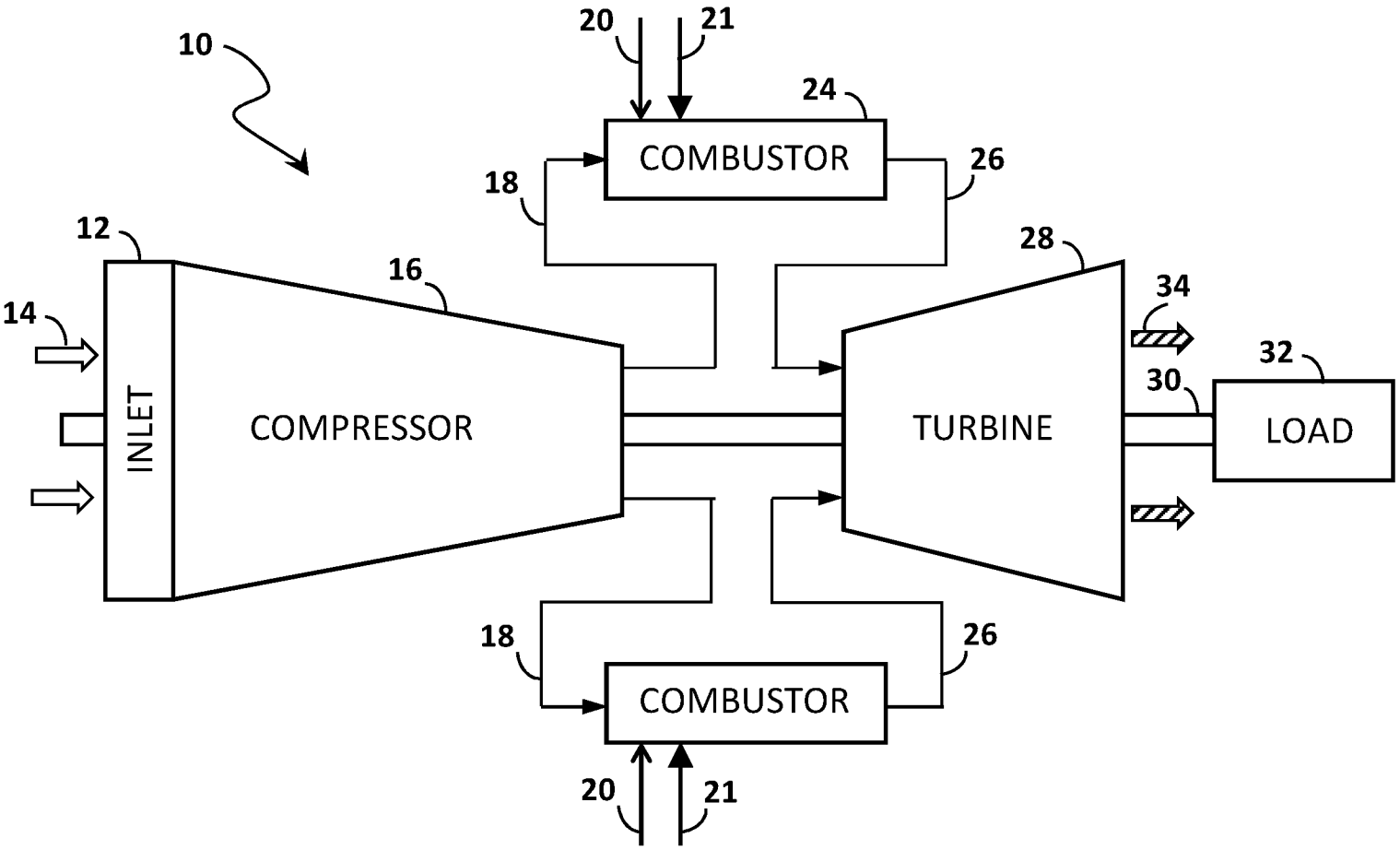
-- FIG. 1 --

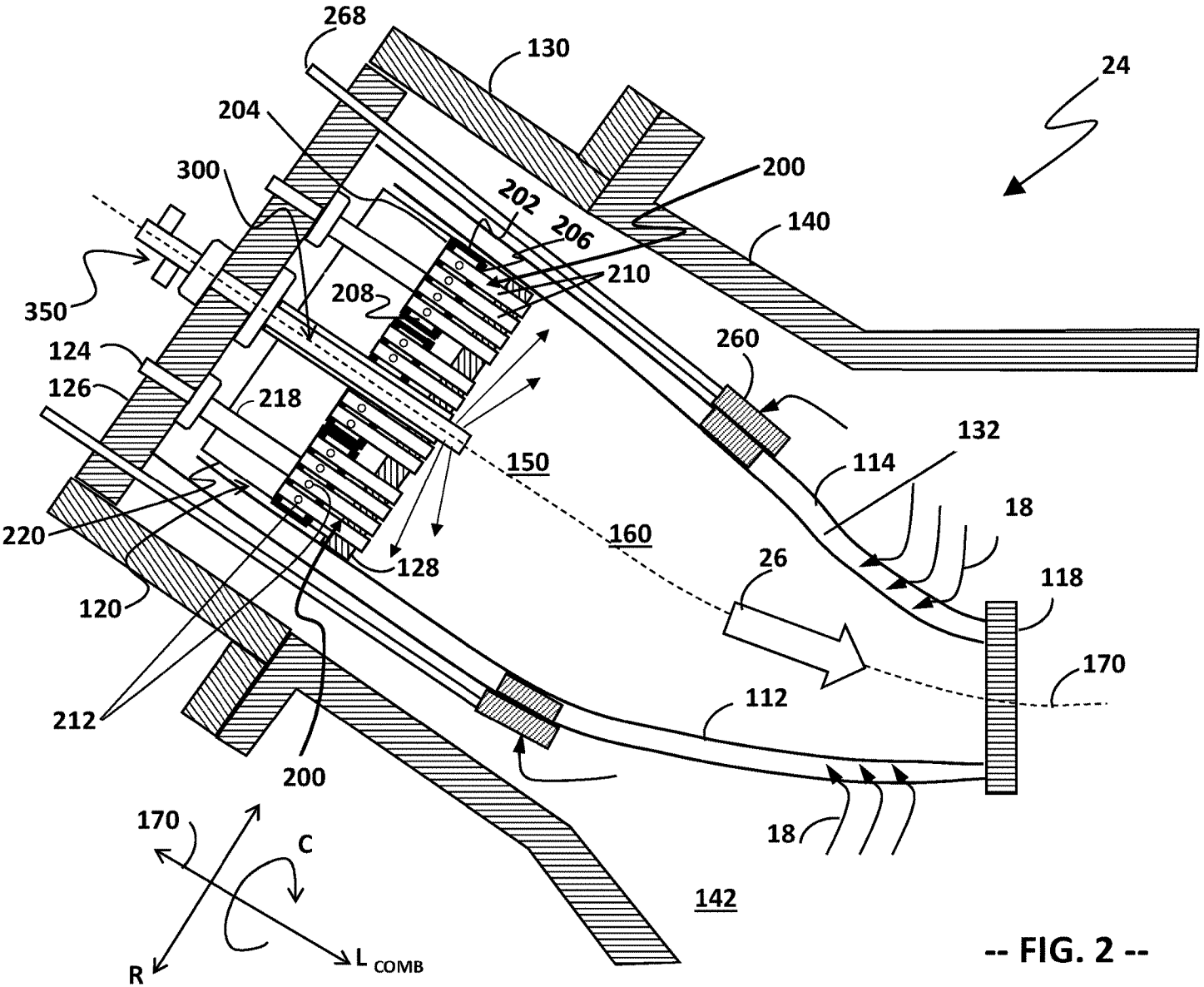
-- FIG. 2 --

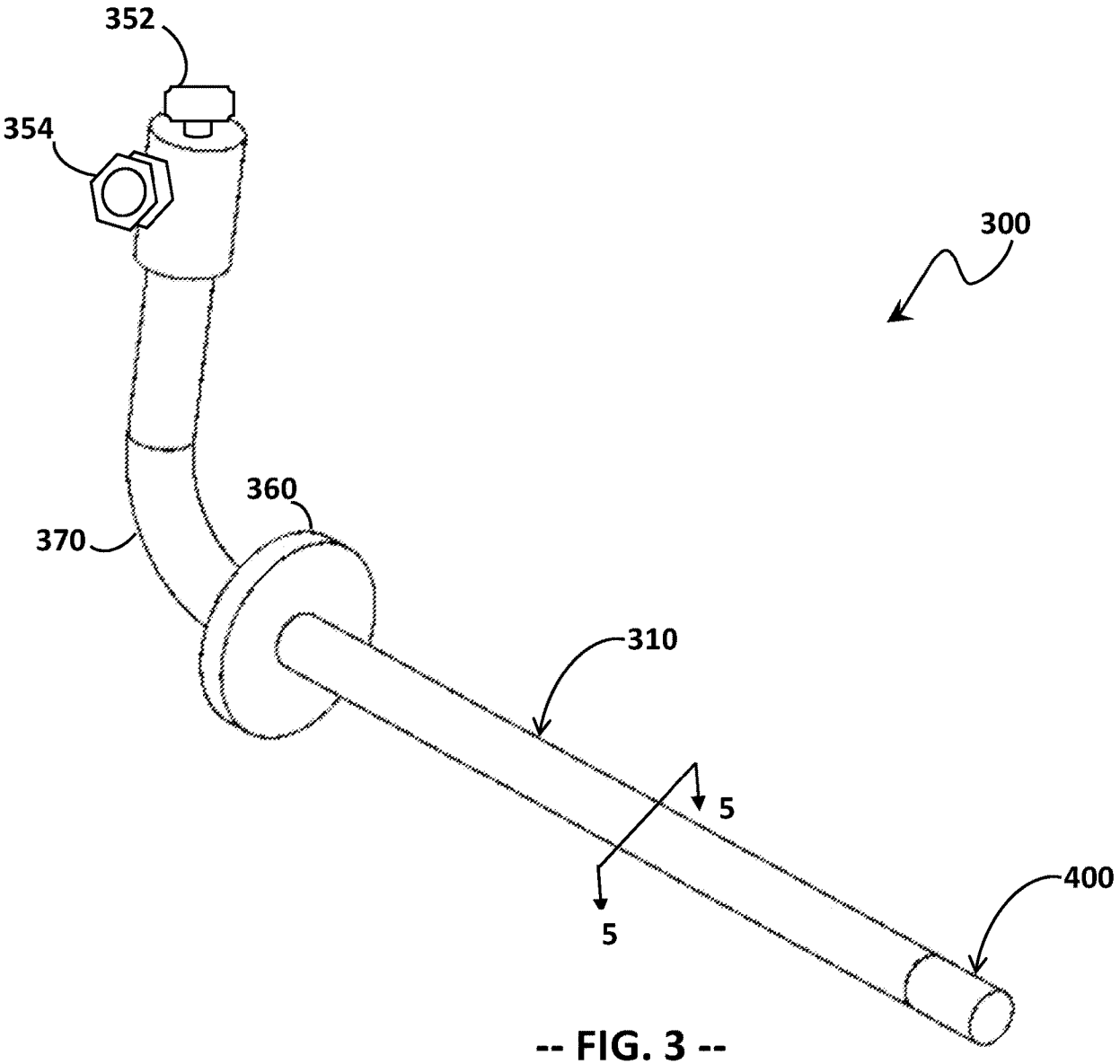
-- FIG. 3 --

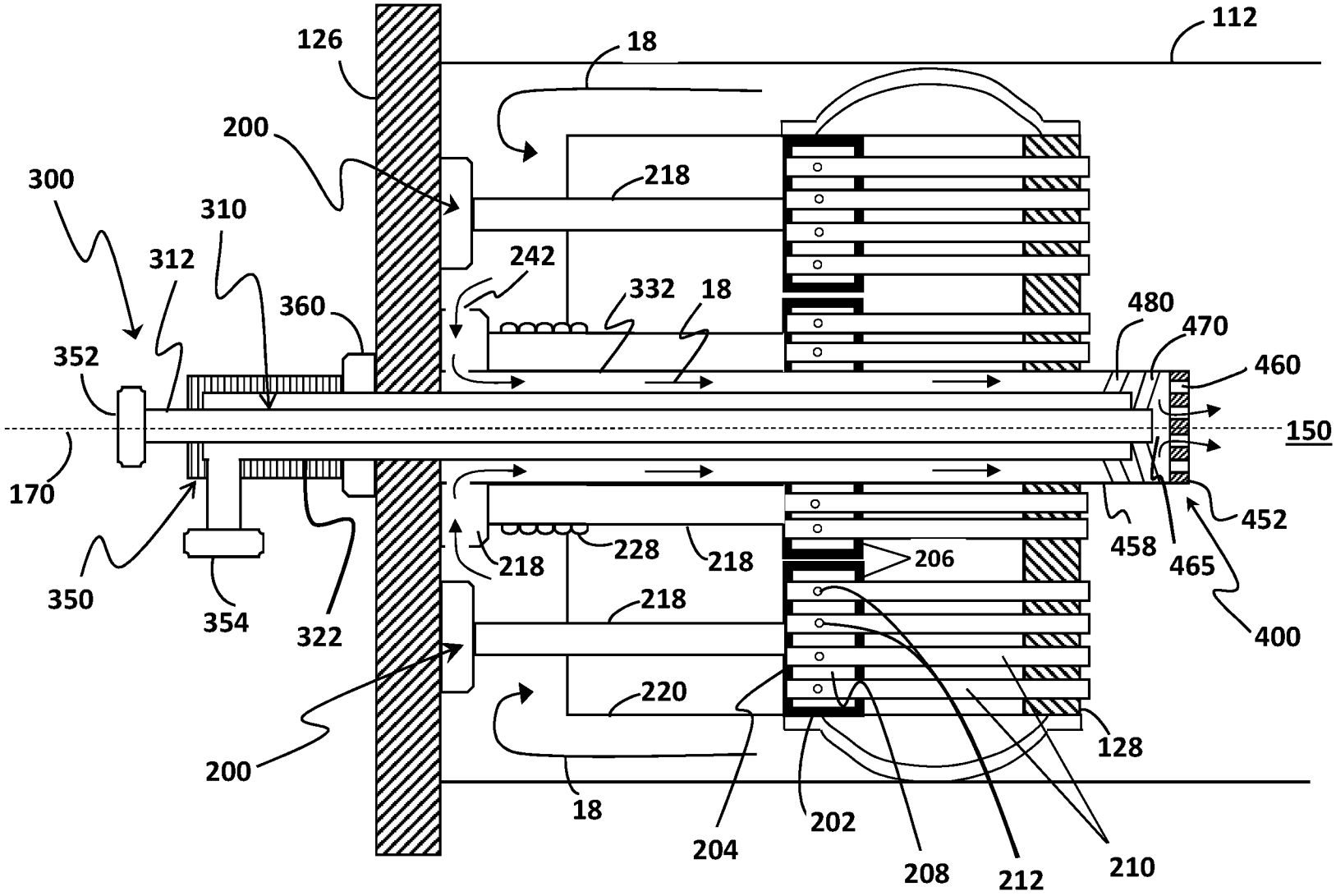
-- FIG. 4 --

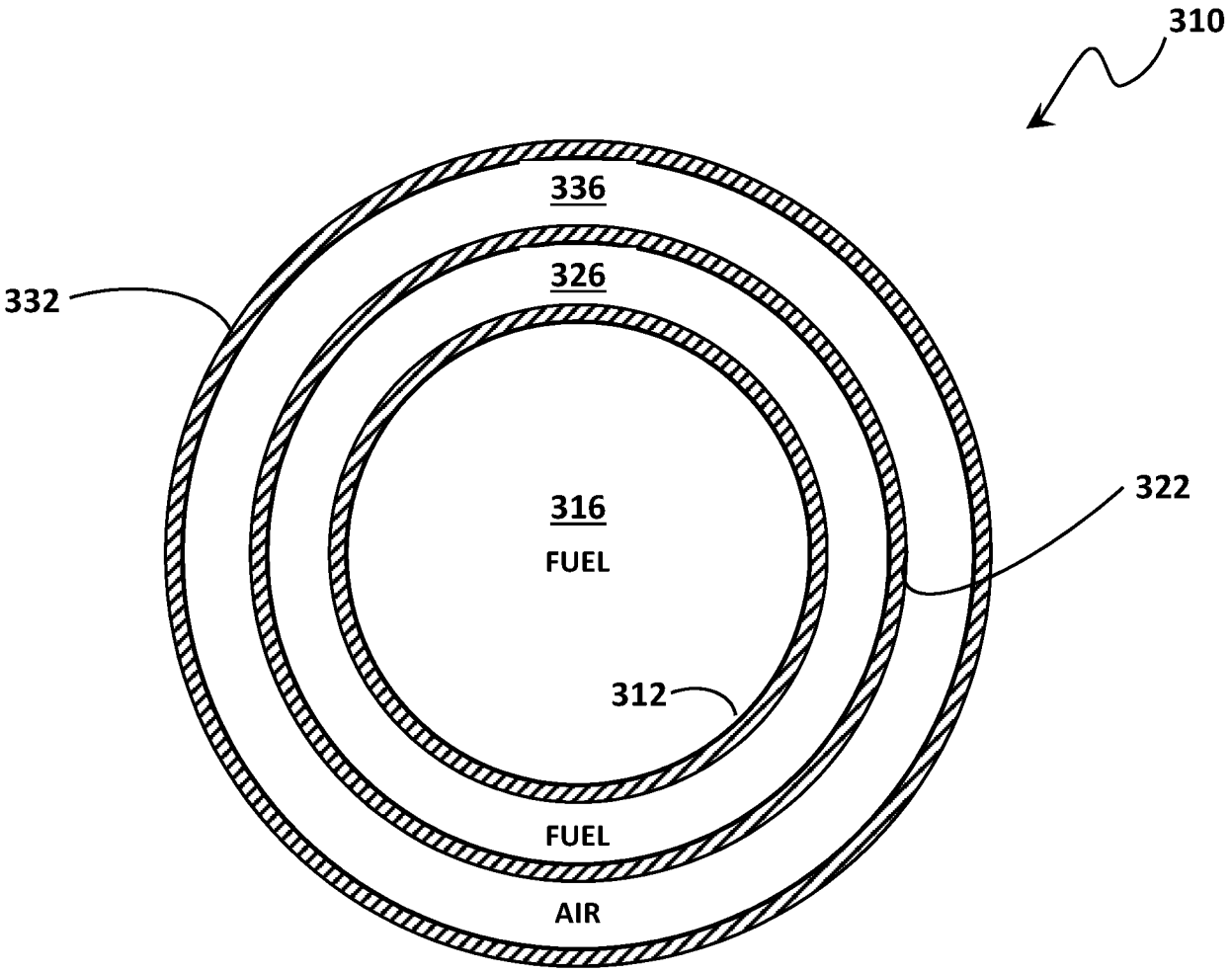
-- FIG. 5 --

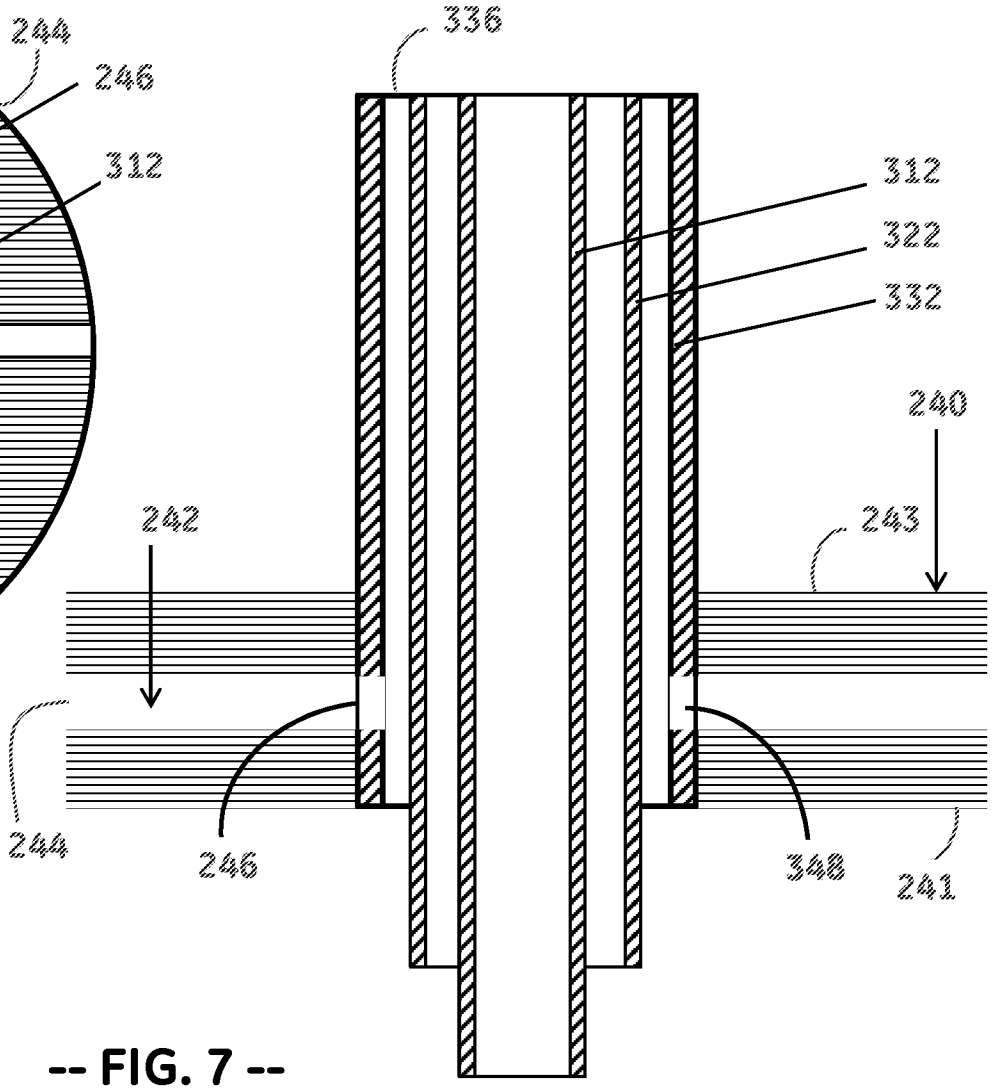
-- FIG. 7 --
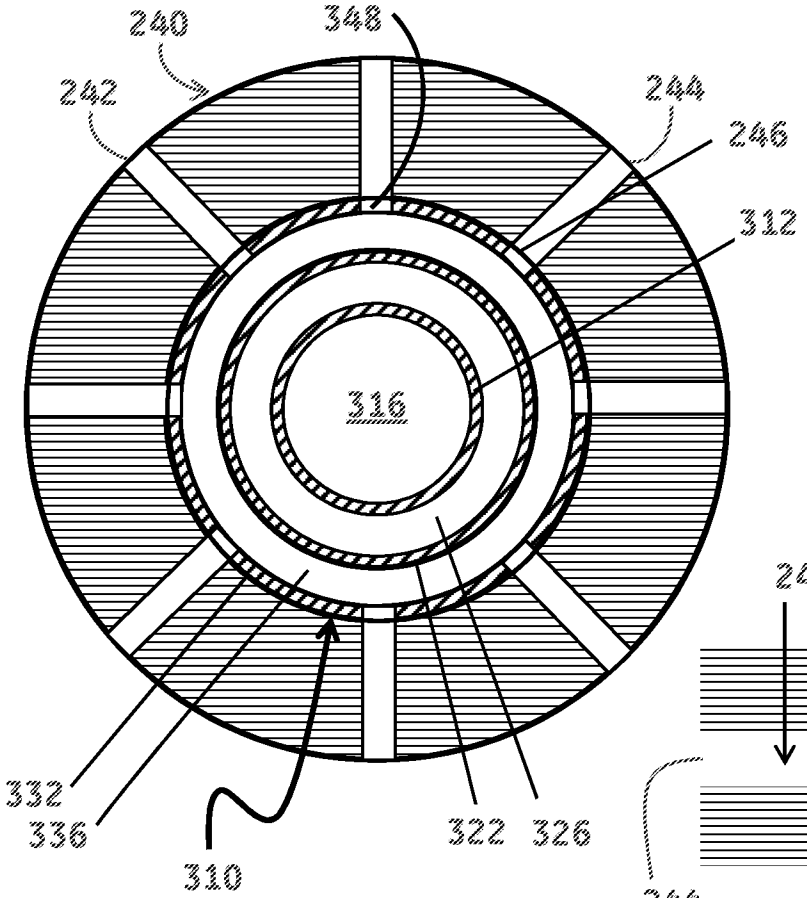
-- FIG. 6 --

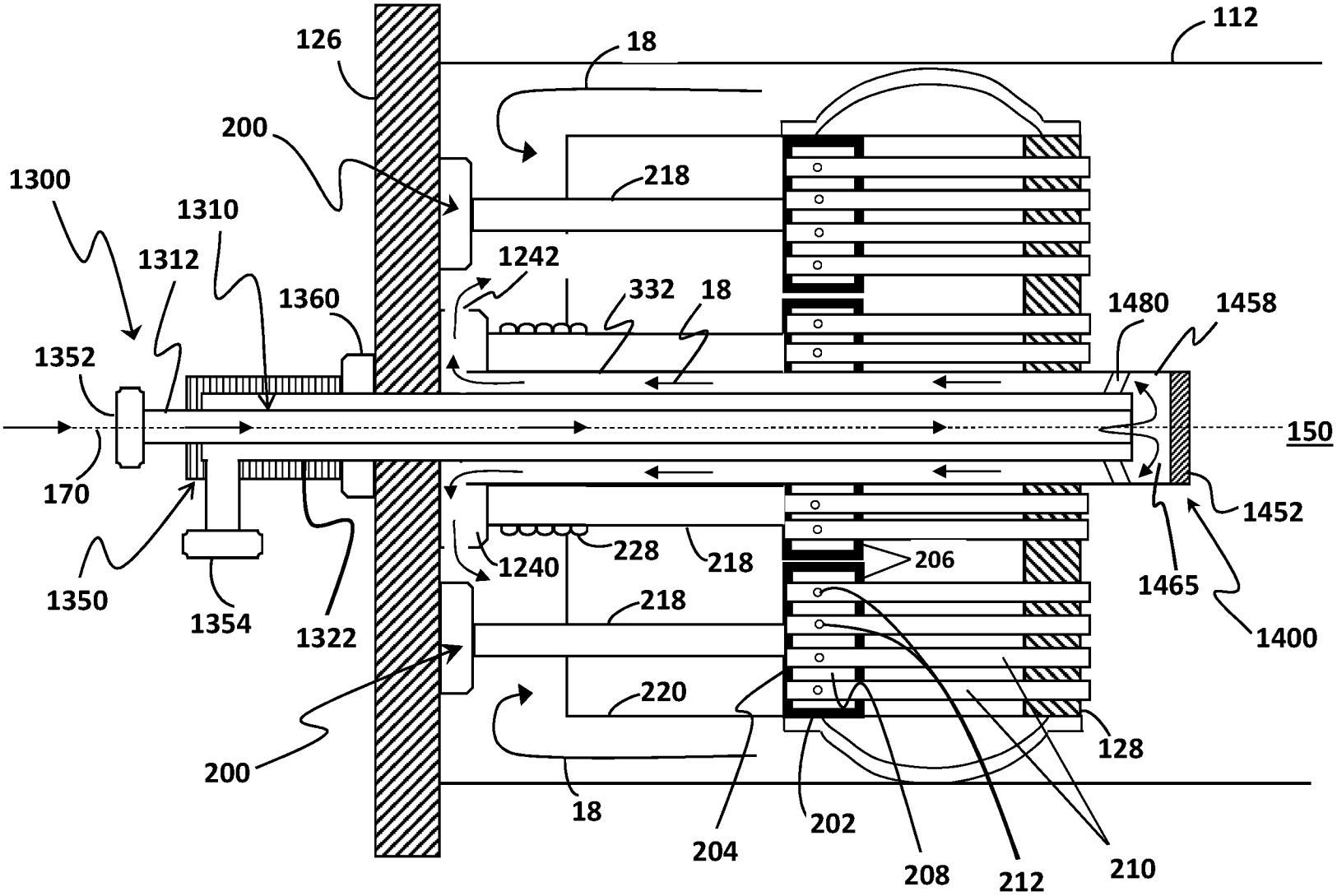
-- FIG. 8 --

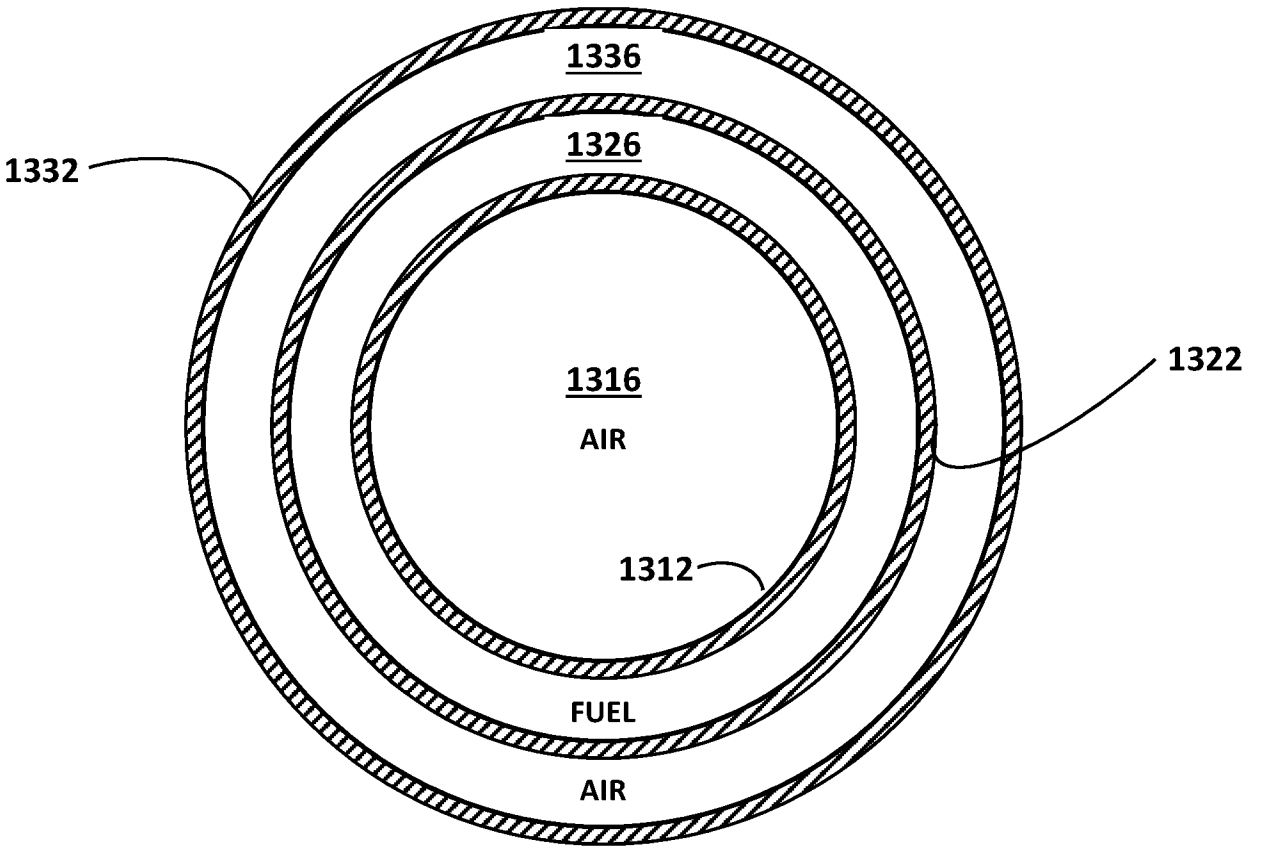
-- FIG. 9 --

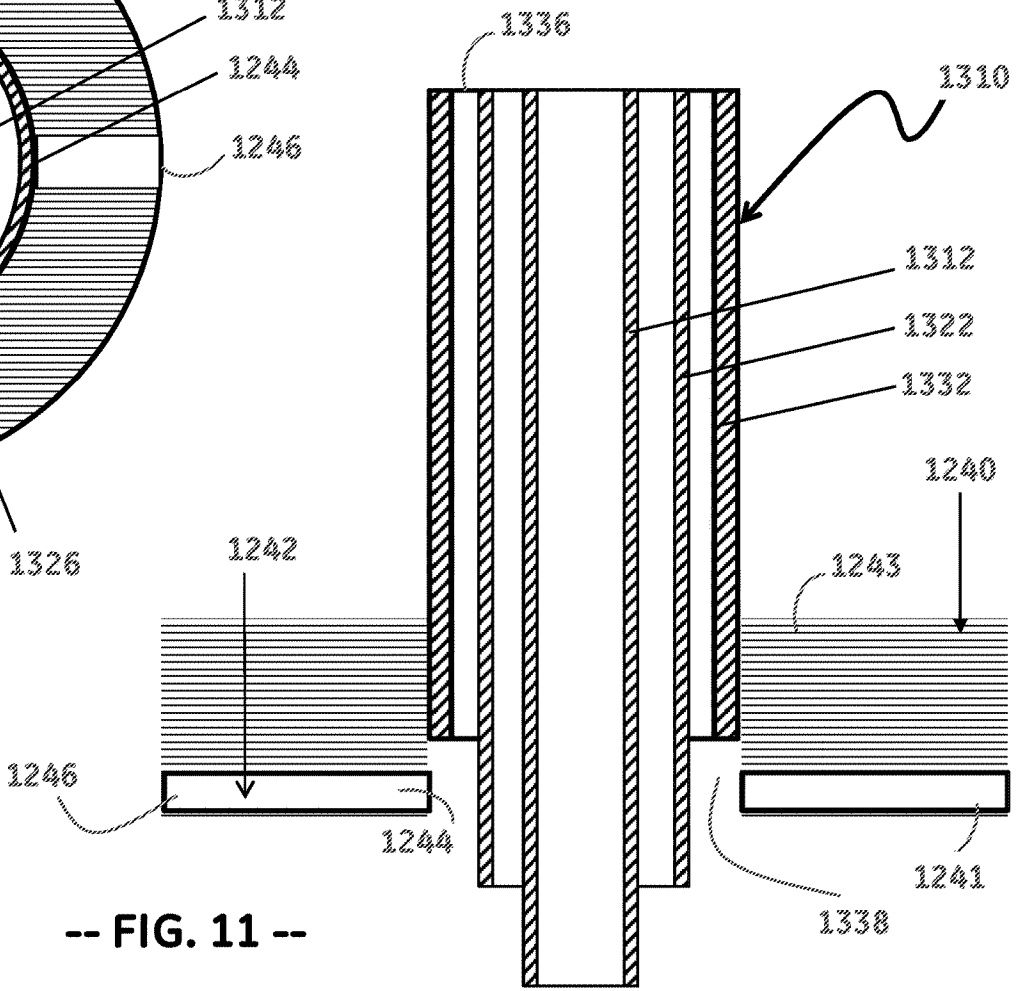
-- FIG. 11 --
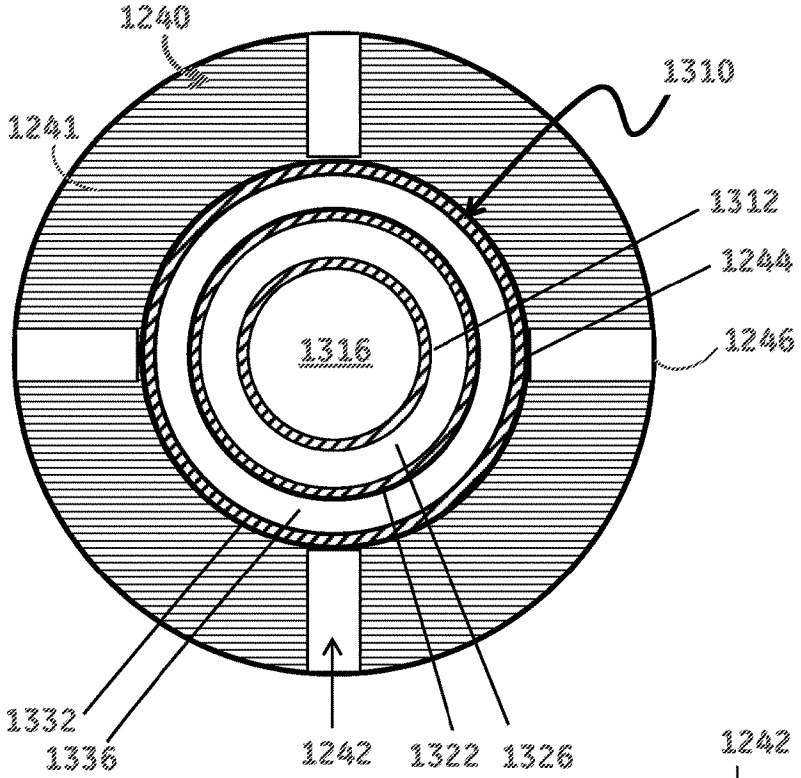
-- FIG. 10 --

COOLING OF LIQUID FUEL CARTRIDGE IN GAS TURBINE COMBUSTOR HEAD END

TECHNICAL FIELD

The present disclosure relates generally to gas turbine combustors and, more particularly, to a liquid fuel cartridge unit for introducing liquid fuel into a gas turbine combustor and assemblies for cooling the liquid fuel cartridge unit.

BACKGROUND

A gas turbine generally includes a compressor section, a combustion section having a combustor, and a turbine section. The compressor section progressively increases the pressure of the working fluid to supply a compressed working fluid to the combustion section. The compressed working fluid is routed through one or more fuel nozzles that extend axially within a forward, or head, end of the combustor. A fuel is combined with the flow of the compressed working fluid to form a combustible mixture. The combustible mixture is burned within a combustion chamber to generate combustion gases having a high temperature, pressure, and velocity. The combustion chamber is defined by one or more liners or ducts that define a hot gas path through which the combustion gases are conveyed into the turbine section. In a can-annular type combustion system, multiple combustion cans (each having its own fuel nozzle(s) and liner) produce combustion gases that drive the turbine section.

The combustion gases expand as they flow through the turbine section to produce work. For example, expansion of the combustion gases in the turbine section may rotate a shaft connected to a generator to produce electricity. The turbine may also drive the compressor by means of a common shaft or rotor.

In the combustor section, the fuel nozzles may operate solely on gaseous fuel, solely on liquid fuel, or simultaneously on gaseous fuel and liquid fuel. In many instances, a power-generation plant may experience sustained periods when it is necessary to operate using only liquid fuel.

One challenge commonly associated with liquid fuel operation is the tendency of the liquid fuel to coke within the fuel nozzle at temperatures that are only moderately elevated over ambient temperatures and significantly below the flame temperature within the combustion chamber.

Therefore, an improved liquid fuel cartridge for delivering a liquid fuel to a combustion chamber is needed in the industry.

SUMMARY

The present disclosure provides assemblies for cooling a liquid fuel cartridge unit within a combustor head end. In one embodiment, the cooling is accomplished passively as air from the head end air plenum is directed into a cooling channel radially outward of a liquid fuel delivery conduit. In another embodiment, the cooling of the liquid fuel cartridge unit is accomplished actively as air is directed through a first air flow conduit radially inward of the liquid fuel delivery conduit and then redirected through a second air flow conduit radially outward of the liquid fuel delivery conduit.

Specifically, according to one embodiment, the present disclosure is directed to a combustor head end that includes an end cover, a cap axially spaced from the end cover, and a sleeve extending axially between the end cover and the cap to define a head end air plenum. A mounting flange, which is attached to a hot side of the cover, defines at least one air flow passage in flow communication with the head end plenum. A liquid fuel cartridge unit, which extends through the mounting flange, includes a nozzle tip extending downstream of the cap, a liquid fuel delivery conduit in flow communication with the nozzle tip, and a cooling channel radially outward of the liquid fuel delivery conduit and in flow communication with the nozzle tip. Air from the head end air plenum flows through the at least one air flow passage in the mounting flange into the cooling channel and exits through at least one cooling hole in the nozzle tip.

Further, according to another embodiment, a combustor head end includes an end cover, a cap axially spaced from the end cover, and a sleeve extending axially between the end cover and the cap to define a head end air plenum. A mounting flange, which is attached to a hot side of the cover, defines at least one air flow passage in flow communication with the head end plenum. A liquid fuel cartridge unit, which extends through the mounting flange, includes a nozzle tip extending downstream of the cap and defining a nozzle air plenum therein, a liquid fuel delivery conduit in flow communication with the nozzle tip, a first air flow conduit radially inward of the liquid fuel delivery conduit and in flow communication with the nozzle air plenum, and a second air flow conduit radially outward of the liquid fuel delivery conduit and in flow communication with the nozzle air plenum. Air flows in a downstream direction through the first air flow conduit to the nozzle air plenum; from the nozzle air plenum in an upstream direction through the second air flow conduit; from an outlet port in the second air flow conduit through the at least one air flow passage in the mounting flange and into the head end air plenum.

BRIEF DESCRIPTION OF THE DRAWINGS

A full and enabling disclosure of the present products and methods, including the best mode thereof, directed to one of ordinary skill in the art, is set forth in the specification, which refers to the appended figures, in which:

FIG. 1 is a schematic diagram of a gas turbine assembly, which may employ one or more fuel injectors, as described herein;

FIG. 2 is a cross-sectional view of a combustor, which may be used in the gas turbine assembly of FIG. 1;

FIG. 3 is a perspective view of a liquid fuel cartridge unit, as may be used in the combustor of FIG. 2;

FIG. 4 is a cross-sectional view of a head end of a combustor, according to one embodiment of the present disclosure;

FIG. 5 is a cross-sectional view of the liquid fuel cartridge unit of FIG. 4, taken along an axial plane of the liquid fuel cartridge unit between a cartridge tip and a fluid manifold hub;

FIG. 6 is a cross-sectional view of a mounting flange for the liquid fuel cartridge unit of FIG. 4, as taken along an axial plane proximate the end cover; and FIG. 7 is a cross-sectional view of a portion of the mounting flange of FIG. 6 and a conduit assembly, as taken along a longitudinal axis through the conduit assembly;

FIG. 8 is a cross-sectional view of a head end of a combustor, according to another embodiment of the present disclosure;

FIG. 9 is a cross-sectional view of the liquid fuel cartridge unit of FIG. 8, taken along an axial plane of the liquid fuel cartridge unit between a cartridge tip and a fluid manifold hub;

FIG. 10 is a cross-sectional view of a mounting flange of the liquid fuel cartridge unit of FIG. 8, as taken along an axial plane adjacent the end cover; and FIG. 11 is a cross-sectional view of a portion of the mounting flange of FIG. 10 and a conduit assembly, as taken along a longitudinal axis through the conduit assembly.

DETAILED DESCRIPTION

The following detailed description illustrates a gas turbine combustor, a liquid fuel cartridge unit for delivering liquid fuel to the gas turbine combustor, and a method of assembling a liquid fuel cartridge unit for a gas turbine combustor, by way of example and not limitation. The description enables one of ordinary skill in the art to make and use the liquid fuel cartridge unit. The description includes what is presently believed to be the best modes of making and using the present liquid fuel cartridge unit. An exemplary liquid fuel cartridge unit is described herein as being coupled to a combustor of a heavy-duty gas turbine assembly used for electrical power generation. However, it is contemplated that the liquid fuel cartridge unit described herein may have general application to a broad range of systems in a variety of fields other than electrical power generation.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

The term "radially" refers to the relative direction that is substantially perpendicular to an axial centerline of a particular component, and the term "axially" refers to the relative direction that is substantially parallel to an axial centerline of a particular component. As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

Each example is provided by way of explanation, not limitation of the invention. In fact, it will be apparent to those skilled in the art that modifications and variations can be made in the present liquid fuel cartridge unit, without departing from the scope or spirit of the present disclosure. For instance, features illustrated or described as part of one embodiment may be used on another embodiment to yield a still further embodiment. Thus, it is intended that the present disclosure encompasses such modifications and variations as fall within the scope of the appended claims and their equivalents. Although exemplary embodiments of the present liquid fuel cartridge unit and method will be described generally in the context of a combustor incorporated into a gas turbine for purposes of illustration, one of ordinary skill in the art will readily appreciate that embodiments of the present disclosure may be applied to any combustor incorporated into any turbomachine and is not limited to a gas turbine combustor, unless specifically recited in the claims.

Reference will now be made in detail to various embodiments of the present liquid fuel cartridge unit and method, one or more examples of which are illustrated in the accompanying drawings. The detailed description uses numerical and letter designations to refer to features in the drawings. Like or similar designations in the drawings and description have been used to refer to like or similar parts.

FIG. 1 provides a functional block diagram of an exemplary gas turbine 10 that may incorporate various embodiments of the present disclosure. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18.

The compressed working fluid 18 is mixed with a gaseous fuel 20 from a gaseous fuel supply system and/or a liquid fuel 21 from a liquid fuel supply system to form a combustible mixture within one or more combustors 24. The combustible mixture is burned to produce combustion gases 26 having a high temperature, pressure, and velocity. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section (not shown) that connects the turbine 28 to an exhaust stack downstream from the turbine. The exhaust section may include, for example, a heat recovery steam generator (not shown) for cleaning and extracting additional heat from the exhaust gases 34 prior to release to the environment.

The combustors 24 may be any type of combustor known in the art, and the present invention is not limited to any particular combustor design unless specifically recited in the claims. For example, the combustor 24 may be a can type (sometime called a can-annular type) of combustor.

FIG. 2 is a schematic representation of a combustion can 24, as may be included in a can annular combustion system for the heavy-duty gas turbine 10. In a can annular combustion system, a plurality of combustion cans 24 (e.g., 8, 10, 12, 14, 16, or more) are positioned in an annular array about the shaft 30 that connects the compressor 16 to the turbine 28.

As shown in FIG. 2, the combustion can 24 includes a liner 112 that contains and conveys combustion gases 26 to the turbine. The liner 112 defines a combustion chamber within which combustion occurs. The liner 112 may have a cylindrical liner portion and a tapered transition portion that is separate from the cylindrical liner portion, as in many conventional combustion systems. Alternately, the liner 112 may have a unified body (or "unibody") construction, in which the cylindrical portion and the tapered portion are integrated with one another. Thus, any discussion of the liner 112 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine are integrated into a single unit, sometimes referred to as a "transition nozzle" or an "integrated exit piece."

The liner 112 may be surrounded by an outer sleeve 114, which is spaced radially outward of the liner 112 to define an annulus 132 between the liner 112 and the outer sleeve 114. The outer sleeve 114 may include a flow sleeve portion at the forward end and an impingement sleeve portion at the aft end, as in many conventional combustion systems. Alternately, the outer sleeve 114 may have a unified body (or "unisleeve") construction, in which the flow sleeve portion and the impingement sleeve portion are integrated with one another in the axial direction. As before, any discussion of the outer sleeve 114 herein is intended to encompass both convention combustion systems having a separate flow sleeve and impingement sleeve and combustion systems having a unisleeve outer sleeve.

A head end portion 120 of the combustion can 24 defines the head end air plenum 122 and that includes one or more fuel nozzles 200. The fuel nozzles 200, as illustrated in FIGS. 2, 4, and 8, may be described as bundled tube fuel nozzles. Each fuel nozzle 200 includes a housing 202 extending in an axial direction, which circumscribes a bundle of individual tubes 210 oriented in parallel to one another. Each tube 210 has an inlet end, an outlet end, and one or more fuel injection holes 212 defined through the tube wall between the inlet end and the outlet end.

The housing 202 is joined to an upstream plate 204 and a downstream plate 206, such that a fuel plenum 208 is defined between the housing 202 and the plates 204, 206. The fuel plenum 208 is in fluid communication with a fuel supply conduit 218 and the fuel injection holes 212 of each tube 210. The fuel supply conduit 218 of each fuel nozzle 200 is in fluid communication with a respective fuel inlet 124. The fuel inlets 124 may be formed through an end cover 126 at a forward end of the combustion can 24.

The head end portion 120 of the combustion can 24 is at least partially surrounded by a forward casing 130, which is physically coupled and fluidly connected to a compressor discharge case 140. The compressor discharge case 140 is fluidly connected to an outlet of the compressor 16 and defines a pressurized air plenum 142 that surrounds at least a portion of the combustion can 24. Air 18 flows from the compressor discharge case 140 into the annulus 132 at an aft end of the combustion can, via openings defined in the outer sleeve 114. Because the annulus 132 is fluidly coupled to the head end portion 120, the air flow 18 travels upstream from the aft end 118 of the combustion can 24 to the head end air plenum 122, where the air flow 18 reverses direction and enters the fuel nozzles 200. An inlet flow conditioner 220 having a plurality of openings or slots (not separately shown) may be used to condition or homogenize the flow entering the fuel nozzles 200.

The tubes 210 have inlet ends defined through corresponding openings (not shown) in the upstream plate 204. Air 18 passes through the inlet ends of the tubes 210 and, during gaseous fuel operation, mixes with fuel passing through the fuel injection holes 212 from the fuel plenum 208. Mixing of the fuel and air 18 occurs between the plane of the fuel injection holes 212 and the outlet ends of the tubes. The downstream (or outlet) ends of the tubes 210 extend through a unified combustor cap 128 (or individual plates corresponding to the size and shape of the upstream plates 204 for each fuel nozzle 200).

During gaseous fuel operation, fuel 20 and compressed air 18 are introduced by the fuel nozzles 200 into a primary combustion zone 150 at a forward end of the liner 112, where the fuel and air are combusted to form combustion gases 26. In the illustrated embodiment, the fuel and air are mixed within the fuel nozzles 200 (e.g., in a premixed fuel nozzle). In other embodiments, the fuel and air may be separately introduced into the primary combustion zone 150 and mixed within the primary combustion zone 150 (e.g., as may occur with a diffusion nozzle). Reference made herein to a "first fuel/air mixture" should be interpreted as describing both a premixed fuel/air mixture and a diffusion-type fuel/air mixture, either of which may be produced by fuel nozzles 200. The combustion gases 26 travel downstream toward the aft end 118 of the combustion can 24, the aft end 118 being represented by an aft frame of the combustion can 24.

When the combustor 24 is operating on gaseous fuel, additional fuel and air may be introduced by one or more fuel injectors 260 into a secondary combustion zone 160, where the fuel and air are ignited by the combustion gases from the primary combustion zone 150 to form a combined combustion gas product stream 26. The fuel injectors 260 receive fuel from a fuel supply line 268 and air from the high-pressure air plenum 142. Such a combustion system having axially separated combustion zones is described as an "axial fuel staging" (AFS) system, and the downstream injectors 260 may be referred to as "AFS injectors."

When the combustion can 24 is operated solely on liquid fuel, the liquid fuel 21 and compressed air 18 are introduced by a liquid fuel cartridge unit 300 into the primary combustion zone 150 at a forward end of the liner 112, where the liquid fuel and air are combusted to form combustion gases 26. The liquid fuel and air are separately introduced into the primary combustion zone 150 and mixed within the primary combustion zone 150 to produce a diffusion-style flame. Throughout this disclosure, the use of the term "liquid fuel" should be understood to encompass both liquid fuel and a liquid fuel/water mixture, unless specifically stated otherwise.

In the illustrated embodiment, the liquid fuel cartridge unit 300 is co-axial with a longitudinal axis of the combustor 24. By having a centrally located liquid fuel cartridge unit 300 (as opposed to localized liquid fuel cartridges installed within each fuel nozzle 200), the surface area available for the tubes 210 is maximized.

In at least one embodiment, the bundled tube fuel nozzles 200 are unfueled during liquid fuel operation. As a result, air flows through the individual tubes 210 of the bundled tube fuel nozzles 200 and produces a plurality of small air streams flowing in a direction generally parallel to the longitudinal axis of the combustor 24.

The liquid fuel cartridge unit 300 includes a cartridge tip 400 having a plurality of fuel injection ports 470 and, optionally, 480 (shown also in FIGS. 3, 4, and 8) that inject streams of liquid fuel 21 in one or more directions transverse, or oblique, to the air streams originating from the tubes 210 of the unfueled bundled tube fuel nozzles 200. The large number of small air streams help to atomize the liquid fuel 21 and facilitate its combustion, while helping to ensure that the liquid fuel droplets do not reach the inner surface of the liner 112.

Additionally, during dedicated liquid fuel operation, the one or more AFS fuel injectors 260 may remain unfueled. In this case, the unfueled AFS injectors 260 direct relatively large streams of air into an area that, in gaseous fuel operation, is the secondary combustion zone 160. In this area, downstream of the primary combustion zone 150, the air from the unfueled AFS injectors 260 effectively churns and mixes the combustion products generated by the liquid fuel cartridge unit 300, such that the combustion products exiting the combustor aft frame 118 resemble those originating from a premixed flame, which is characterized by having a greater degree of mixedness and a higher velocity as compared with those produced by an unimpeded diffusion flame.

FIG. 3 illustrates the liquid fuel cartridge unit 300 in greater detail. The liquid fuel cartridge unit 300 includes a supply tube assembly 310 having a downstream end to which the cartridge tip 400 is attached. A fluid manifold hub 350 is attached to the upstream end of the supply tube assembly 310, and a flange 360 circumscribes the supply tube assembly 310 at a position nearer to the fluid manifold hub 350 than the cartridge tip 400. The fluid manifold hub 350 surrounds the supply tube assembly 310 and may include a first fluid inlet 352, a second fluid inlet 354, and, optionally, a third fluid inlet (not shown).

The supply tube assembly 310 includes a number of nested supply tubes, defining therebetween a number of flow passages. In one embodiment, the supply tubes may be concentric. As best understood with reference to the exemplary embodiments shown in FIGS. 5 and 9, the supply tube assembly 310 is provided with a first supply tube 312 (or 1312), a second supply tube 322 (or 1322) circumferentially surrounding the first supply tube 312 (or 1312), and a third supply tube 332 (or 1332) circumferentially surrounding the second supply tube 322 (or 1322). Optionally, a fourth supply tube (not shown) may circumferentially surround the third supply tube 332 (or 1332).

A first flow passage 316 (or 1316) is defined within the first supply tube 312 (or 1312); a second flow passage 326 (or 1326) is defined between the outer surface of the first supply tube 312 (or 1312) and the inner surface of the second supply tube 322 (or 1322); and a third flow passage 336 (or 1336) is defined between the outer surface of the second supply tube 322 (or 1322) and the inner surface of the third supply tube 332 (or 1332). Where a fourth supply tube is present, a fourth flow passage is defined between the outer surface of the third supply tube 332 (or 1332) and the inner surface of the fourth supply tube. The fourth supply tube may be fed by a separate fluid inlet.

In some instances, to facilitate installation and fuel delivery, the supply tube assembly 310 may be provided with a bend 370 at a location upstream of the cartridge tip 400. The bend 370 is nearer to the upstream ends of the supply tubes 312, 322, 332 and the fluid manifold hub 350 than to the downstream ends of the supply tubes 312, 322, 332 and the cartridge tip 400. In other words, the bend 370 is proximate the upstream ends of the supply tubes 312, 322, 332. The bend 370 may define an approximate right angle (90-degrees+/−5-degrees) or any other angle suitable for delivering fuel from the fluid manifold hub 350. To bend the supply tubes 312, 322, 332 while maintaining their internal spacing, the supply tubes 312, 322, 332 may be filled with a removable material, such as a eutectic alloy, a powder, or a wax.

FIGS. 4 through 7 illustrate various aspects of a passive system for supplying cooling air to the liquid fuel cartridge unit 300. As shown in FIG. 4, the liquid fuel cartridge unit 300 is oriented along a longitudinal axis 170 of the combustor 24 within a center bundled tube fuel nozzle 200. Additional bundled tube fuel nozzles 200 are located radially outward of the center bundled tube fuel nozzle 200.

The liquid fuel cartridge unit 300 includes the nested tube assembly 310 having the first conduit 312, the second conduit 322 circumferentially surrounding the first conduit 312, and a third conduit 332 circumferentially surrounding the second conduit 322. The third conduit 332 is positioned radially inward of a fuel supply conduit 218 supplying fuel to the center bundled tube fuel nozzle 200. Bellows 228 may be positioned along the fuel supply conduit 218 to accommodate thermal stress.

The liquid fuel cartridge unit 300 includes a fluid manifold hub 350 at an upstream end. The fluid manifold hub 350 is positioned upstream of the mounting flange 360, and the conduit assembly 310 extends through the mounting flange 360. The mounting flange 360 is mounted to the cold (upstream) side of the end cover 126.

The first fluid inlet 352 of the fluid manifold hub 350 is in flow communication with the first conduit 312, while the second fluid inlet 354 is in flow communication with the second conduit 322. The first fluid inlet 352 delivers a liquid fuel (or liquid fuel/water mixture) from a liquid fuel supply (not shown) through the first flow passage 316 of the first conduit 312 to a plurality of fuel injection ports 470 of the cartridge tip 400. The second fluid inlet 354 delivers a liquid fuel (or liquid fuel/water mixture) from the liquid fuel supply through the second flow passage 326 of the second conduit 322 to a plurality of fuel injection ports 480 of the cartridge tip 400.

In one embodiment, the first fluid inlet 352 may supply liquid fuel as a pilot fuel, while the second fluid inlet 354 may supply liquid fuel as a main fuel flow. In other embodiments, the first fluid inlet 352 and the second fluid inlet 354 may each supply a portion of the main fuel flow.

In the passively cooled embodiment, air 18 from the head end air plenum 122 flows through at least one air flow passage in a mounting flange 240 connected to the hot (downstream) side of the end cover 126. The air flow passage may be one or more apertures (as shown in FIG. 6) or slots (as shown in FIG. 10). Air 18 flows through the air flow passage(s) in the mounting flange 240 through corresponding apertures in the third conduit 332 and into the third flow passage 336. Air 18 passes through the third flow passage 336, convectively cooling the passages 326 and/or 316 conveying the liquid fuel (or liquid fuel/water mixture). Air 18 moves into an air chamber 465 at the downstream end of the cartridge tip 400 before passing through one or more cooling holes 460 in the aft plate 452 that defines the downstream end.

The fuel injection ports 470, 480 are disposed through a side wall 458 of the cartridge tip 400. The side wall 458 and the aft plate 452 may define a cylindrical shape (as shown in FIG. 4) or a frustoconical shape (as shown in FIG. 3). The fuel injection ports 470, 480 are configured to inject the liquid fuel (or liquid fuel/water mixture) in a direction oblique or transverse to the flow of air through the tubes 210 of the fuel nozzles 200. More than two sets of fuel injection ports may be used, for example, by adding another conduit to the multi-conduit assembly.

FIG. 6 illustrates a cross-section of the mounting flange 240 and the conduit assembly 310, as taken along an axial plane proximate the end cover 126. FIG. 7 illustrates a cross-section of the mounting flange 240 and the conduit assembly 310, as taken along a longitudinal plane of the mounting flange 240 and the conduit assembly 310. As shown, a plurality of air flow passages 242 are formed through the mounting flange 240. The air flow passages 242 are disposed between an upstream surface 241 and a downstream surface 243 of the mounting flange 240. Each air flow passage 242 has an inlet 244 on the outer perimeter of the mounting flange 240 and an outlet 246 on inner perimeter of the mounting flange 240. The outlets 246 are aligned with corresponding ports 348 in the third conduit 332.

To passively cool the liquid fuel cartridge unit 300, air 18 flows from the head end air plenum 122 into the third flow passage 336. The air 18 convectively cools the supply tube assembly 310 and is conveyed through the cooling holes 460 in the aft plate 452.

FIGS. 8 through 11 illustrate various aspects of an active system for supplying cooling air to a liquid fuel cartridge unit 1300. As shown in FIG. 8, the liquid fuel cartridge unit 1300 is oriented along a longitudinal axis 170 of the combustor 24 within a center bundled tube fuel nozzle 200. Additional bundled tube fuel nozzles 200 are located radially outward of the center bundled tube fuel nozzle 200.

The liquid fuel cartridge unit 1300 includes a nested tube assembly 1310 having a first conduit 1312, a second conduit 1322 circumferentially surrounding the first conduit 1312, and a third conduit 1332 circumferentially surrounding the second conduit 1322. The third conduit 1332 is positioned radially inward of the fuel supply conduit 218 supplying fuel to the center bundled tube fuel nozzle 200. The first conduit 1312, the second conduit 1322, and the third conduit 1332 may, in some embodiments, be concentric with one another.

The liquid fuel cartridge unit 1300 includes a fluid manifold hub 1350 at an upstream end. The fluid manifold hub 1350 is positioned upstream of the mounting flange 1360, and the conduit assembly 1310 extends through the mounting flange 1360. The mounting flange 1360 is mounted to the cold (upstream) side of the end cover 126.

The first fluid inlet 1352 of the fluid manifold hub 1350 is in flow communication with the first conduit 1312, while the second fluid inlet 1354 is in flow communication with the second conduit 1322. The first fluid inlet 1352 delivers pressurized cooling air 18 through the first flow passage 1316 of the first conduit 1312 to an aft plate 1452 of a cartridge tip 1400. The second fluid inlet 1354 delivers a liquid fuel (or liquid fuel/water mixture) through the second flow passage 1326 of the second conduit 1322 to a plurality of fuel injection ports 1480 of the cartridge tip 1400.

The fuel injection ports 1480 are disposed through a side wall 1458 of the cartridge tip 1400. The side wall 1458 and the aft plate 1452 may define a cylindrical shape (as shown in FIG. 8) or a frustoconical shape (as shown in FIG. 3). The fuel injection ports 1480 are configured to inject the liquid fuel (or liquid fuel/water mixture) in a direction oblique or transverse to the flow of air through the tubes 210 of the fuel nozzles 200.

In this exemplary embodiment, a single conduit (i.e., conduit 1322) delivers fuel to a single plurality of fuel injection ports (i.e., ports 1480). However, it should be well appreciated that an additional nested conduit (such as is shown in FIGS. 4 and 5) may be used to provide an additional fuel circuit, and the cartridge tip 1400 may include corresponding fuel injection ports to introduce the fuel from the additional fuel circuit. Thus, the active cooling system is not to be limited to the single fuel conduit 1322 illustrated for the sake of simplicity in the drawings.

In the actively cooled embodiment, air 18 from the first fluid inlet 1352 flows through the first conduit 1312 to the aft end 1452 of the cartridge tip 1400, where an air chamber 1465 is formed. From the air chamber 1465, the air 18 reverses direction and flows into the third flow passage 1336 of the third conduit 1332, thus creating counter-flowing streams of air 18 radially inward and radially outward of the second conduit 1322 that contains the liquid fuel (or liquid fuel/water mixture). Air 18 flows out of the third conduit 1332 and through at least one air flow passage 1242 in a mounting flange 1240 connected to the hot (downstream) side of the end cover 126. As described above, the air flow passage 1242 may be one or more apertures (as shown in FIG. 6) or slots (as shown in FIG. 10). Exiting the mounting flange 1240, the air 18 enters the head end plenum 122, where the air 18 mixes with air flowing into the bundled tube fuel nozzles 200 to participate in the combustion reaction.

FIG. 10 illustrates a cross-section of the mounting flange 1240 and the conduit assembly 1310, as taken along an axial plane proximate the end cover 126. FIG. 11 illustrates a cross-section of the mounting flange 1240 and the conduit assembly 1310, as taken along a longitudinal plane of the mounting flange 1240 and the conduit assembly 1310. As shown, a plurality of air flow passages 1242 are formed through the mounting flange 1240. The air flow passages 1242 are disposed proximate an upstream surface 1241 of the mounting flange 1240. Each air flow passage 1242 has an inlet 1244 on the inner perimeter of the mounting flange 1240 and an outlet 1246 on outer perimeter of the mounting flange 1240.

To actively cool the liquid fuel cartridge unit 1300, air 18 flows through the first flow passage 1316 defined by the first conduit 1312 into the air chamber 1465 at the cartridge tip 400 and, from the air chamber 1465, into the third flow passage 1336 defined between the second conduit 1322 and the third conduit 1332. As shown in FIG. 11, the third conduit 1332 may be welded, or otherwise joined, to the mounting flange 1240, such that an air gap 1338 is formed between the upstream end of the third conduit 1332 and the upstream surface 1241 of the mounting flange 1240. Such an air gap 1338 is not required, but may be used instead of the ports 348 shown in FIGS. 6 and 7.

The methods and devices described herein facilitate the introduction of liquid fuel in the head end of a power-generating gas turbine combustor. More specifically, the methods and devices facilitate the cooling of a liquid fuel cartridge unit for delivering liquid fuel (or a liquid fuel/water mixture) through a centrally located liquid fuel cartridge unit in such a way as to improve the distribution of the liquid fuel across the combustion zone without wetting the walls of the surrounding liner. Used in conjunction with a head end including unfueled bundled tube fuel nozzles, the air streams from the individual tubes help to atomize the liquid fuel and produce a stable diffusion flame. The active and passive cooling assemblies provided herein help to reduce the likelihood of liquid fuel coking within the liquid fuel cartridge unit.

The present methods and devices therefore facilitate improving the overall operating efficiency of a combustor such as, for example, a combustor in a turbine assembly. This increases the turbine output. Moreover, the present fuel liquid fuel cartridge unit provides greater operational flexibility in that the combustor is configured to burn both liquid fuel and natural gas at different times.

Exemplary embodiments of the liquid fuel cartridge unit and methods of cooling the same are described above in detail. The methods and devices described herein are not limited to the specific embodiments described herein, but rather, components of the methods and devices may be utilized independently and separately from other components described herein. For example, the methods and devices described herein may have other applications not limited to practice with turbine assemblies, as described herein. Rather, the methods and devices described herein can be implemented and utilized in connection with various other industries.

While the invention has been described in terms of various specific embodiments, those skilled in the art will recognize that the invention can be practiced with modification within the spirit and scope of the claims.

What is claimed is:

1. A combustor head end comprising:

an end cover;

a cap axially spaced from the end cover;

a sleeve extending axially between the end cover and the cap, thereby defining a head end air plenum;

a center bundled tube fuel nozzle disposed along a longitudinal axis of the combustor head end, the center bundled tube fuel nozzle comprising an upstream plate, an aft plate, a shroud extending axially between the upstream plate and the aft plate to define a fuel plenum, a plurality of premixing tubes extending through the fuel plenum and the cap, such that outlets of the plurality of premixing tubes are downstream of the cap;

a mounting flange attached to a hot side of the end cover, the mounting flange defining at least one air flow passage in flow communication with the head end air plenum; and a liquid fuel cartridge extending through the mounting flange, the liquid fuel cartridge comprising a nozzle tip extending downstream of the cap, a liquid fuel delivery conduit in flow communication with the nozzle tip, and a cooling channel in flow communication with the nozzle tip;

wherein air from the head end air plenum flows through the at least one air flow passage in the mounting flange into the cooling channel and exits through at least one cooling hole in the nozzle tip.

2. The combustor head end of claim 1, wherein the at least one air flow passage in the mounting flange comprises a plurality of apertures circumferentially spaced about the mounting flange.

3. The combustor head end of claim 1, wherein the liquid fuel cartridge further comprises a cartridge mounting flange, the cartridge mounting flange being mounted to a cold side of the end cover.

4. The combustor head end of claim 1, wherein the liquid fuel cartridge comprises a first tube surrounded by a second tube, the first tube being the liquid fuel delivery conduit, the liquid fuel delivery conduit being in flow communication with a liquid fuel supply.

5. The combustor head end of claim 4, wherein the second tube defines, at an upstream end thereof, at least one port in flow communication with the air from the head end plenum, via the at least one air flow passage in the mounting flange.

6. The combustor head end of claim 1, wherein the nozzle tip comprises a plurality of fuel injection ports configured to direct the liquid fuel in a predominantly radial direction relative to a longitudinal axis of the liquid fuel cartridge.

7. The combustor head end of claim 1, wherein the liquid fuel cartridge extends coaxially through the center bundled tube fuel nozzle, the nozzle tip of the liquid fuel cartridge projecting axially downstream of the outlets of the plurality of premixing tubes.

8. The combustor head end of claim 1, further comprising a plurality of outer bundled tube fuel nozzles circumferentially surrounding the center bundled tube fuel nozzle.

* * * * *